US007749069B2

(12) United States Patent
Randall

(10) Patent No.: US 7,749,069 B2
(45) Date of Patent: Jul. 6, 2010

(54) ENTERTAINMENT AND GAMING DEVICES COUPLED TO AN INDICATION OF PAYOUT PERCENTAGE CHARACTERISTICS

(75) Inventor: Dov L. Randall, Las Vegas, NV (US)

(73) Assignee: IGT-UK Limited, Lancashire (GB)

( * ) Notice: Subject to any disclaimer, the term of this patent is extended or adjusted under 35 U.S.C. 154(b) by 1109 days.

(21) Appl. No.: 10/844,203

(22) Filed: May 12, 2004

(65) Prior Publication Data

US 2005/0208992 A1 Sep. 22, 2005

(30) Foreign Application Priority Data

May 13, 2003 (GB) ..... 0310924.6

(51) Int. Cl.
*A63F 9/24* (2006.01)

(52) U.S. Cl. ..... 463/20; 463/16; 463/25; 463/31

(58) Field of Classification Search ..... 463/16–20, 463/30–33, 42, 25
See application file for complete search history.

(56) References Cited

U.S. PATENT DOCUMENTS

| | | | |
|---|---|---|---|
| 4,448,419 | A | 5/1984 | Telnaes |
| 4,582,324 | A | 4/1986 | Koza et al. |
| 4,624,459 | A | 11/1986 | Kaufman |
| 4,695,053 | A | 9/1987 | Vazquez, Jr. et al. |
| 4,805,907 | A | 2/1989 | Hagiwara |
| 4,837,728 | A | 6/1989 | Barrie et al. |
| 4,991,848 | A | 2/1991 | Greenwood et al. |
| 5,178,390 | A | 1/1993 | Okada |
| 5,205,555 | A | 4/1993 | Hamano |
| 5,221,083 | A | 6/1993 | Dote |
| 5,342,047 | A | 8/1994 | Heidel et al. |
| 5,407,200 | A | 4/1995 | Zalabak |
| 5,456,465 | A | 10/1995 | Durham |
| 5,524,888 | A | 6/1996 | Heidel |
| 5,536,016 | A | 7/1996 | Thompson |
| 5,542,669 | A | 8/1996 | Charron et al. |
| 5,564,700 | A | 10/1996 | Celona |
| 5,611,535 | A | 3/1997 | Tiberio |

(Continued)

FOREIGN PATENT DOCUMENTS

EP 0874337 A1 10/1998

(Continued)

OTHER PUBLICATIONS

In Between Game Description written by IGT, available prior to 2000.

(Continued)

*Primary Examiner*—Dmitry Suhol
*Assistant Examiner*—Andrew Kim
(74) *Attorney, Agent, or Firm*—K&L Gates LLP

(57) ABSTRACT

Coin-operated player-operable entertainment machines, such as fruit machines with symbol-selecting reels, are linked to a common display device. The machines are used to play games which may result in wins, dependent upon at least one machine parameter. The machine parameter may be the percentage pay out for which the machines are set, i.e., the proportion of stake value returned as awards. The percentages may be different for different machines and this may be shown on the common display device.

36 Claims, 2 Drawing Sheets

U.S. PATENT DOCUMENTS

| | | | |
|---|---|---|---|
| 5,611,730 | A | 3/1997 | Weiss |
| 5,645,486 | A | 7/1997 | Nagao et al. |
| 5,655,961 | A | 8/1997 | Acres et al. |
| D383,171 | S | 9/1997 | Hanscom |
| 5,664,998 | A | 9/1997 | Seelig et al. |
| 5,702,304 | A | 12/1997 | Acres et al. |
| 5,711,525 | A | 1/1998 | Breeding |
| 5,741,183 | A | 4/1998 | Acres et al. |
| 5,752,882 | A | 5/1998 | Acres et al. |
| 5,769,716 | A | 6/1998 | Saffari et al. |
| 5,775,692 | A | 7/1998 | Watts et al. |
| 5,779,544 | A | 7/1998 | Seelig et al. |
| 5,788,573 | A | 8/1998 | Baerlocher et al. |
| 5,816,920 | A | 10/1998 | Hanai |
| 5,820,459 | A | 10/1998 | Acres et al. |
| 5,823,874 | A | 10/1998 | Adams |
| 5,833,538 | A | 11/1998 | Weiss |
| 5,836,817 | A | 11/1998 | Acres et al. |
| 5,848,932 | A | 12/1998 | Adams |
| 5,851,148 | A | 12/1998 | Brune et al. |
| 5,873,781 | A | 2/1999 | Keane |
| 5,876,284 | A | 3/1999 | Acres et al. |
| 5,902,184 | A | 5/1999 | Bennett et al. |
| 5,947,820 | A | 9/1999 | Morro et al. |
| 5,951,397 | A | 9/1999 | Dickinson |
| 5,964,463 | A | 10/1999 | Moore, Jr. |
| 5,967,894 | A | 10/1999 | Kinoshita et al. |
| 5,980,384 | A | 11/1999 | Barrie |
| 5,984,781 | A | 11/1999 | Sunaga |
| 5,997,400 | A | 12/1999 | Seelig et al. |
| 5,997,401 | A | 12/1999 | Crawford |
| 6,004,207 | A | 12/1999 | Wilson, Jr. et al. |
| 6,015,346 | A | 1/2000 | Bennett |
| 6,056,642 | A | 5/2000 | Bennett |
| 6,059,289 | A | 5/2000 | Vancura |
| 6,062,980 | A | 5/2000 | Luciano |
| 6,068,553 | A | 5/2000 | Parker |
| 6,077,161 | A | 6/2000 | Wisler |
| 6,089,976 | A | 7/2000 | Schneider et al. |
| 6,089,977 | A | 7/2000 | Bennett |
| 6,089,980 | A | 7/2000 | Gauselmann |
| 6,093,102 | A | 7/2000 | Bennett |
| 6,102,798 | A | 8/2000 | Bennett |
| 6,120,031 | A | 9/2000 | Adams |
| 6,126,541 | A | 10/2000 | Fuchs |
| 6,126,542 | A | 10/2000 | Fier |
| 6,142,874 | A | 11/2000 | Kodachi et al. |
| 6,142,875 | A | 11/2000 | Kodachi et al. |
| 6,146,273 | A | 11/2000 | Olsen |
| 6,159,095 | A | 12/2000 | Frohm et al. |
| 6,159,096 | A | 12/2000 | Yoseloff |
| 6,159,097 | A | 12/2000 | Gura |
| 6,162,121 | A | 12/2000 | Morro et al. |
| 6,168,520 | B1 | 1/2001 | Baerlocher et al. |
| 6,168,523 | B1 | 1/2001 | Piechowiak et al. |
| 6,173,955 | B1 | 1/2001 | Perrie et al. |
| 6,174,233 | B1 | 1/2001 | Sunaya et al. |
| 6,174,235 | B1 | 1/2001 | Walker et al. |
| 6,190,254 | B1 | 2/2001 | Bennett |
| 6,190,255 | B1 | 2/2001 | Thomas et al. |
| 6,203,429 | B1 | 3/2001 | Demar et al. |
| 6,210,279 | B1 | 4/2001 | Dickinson |
| 6,213,876 | B1 | 4/2001 | Moore, Jr. |
| 6,217,448 | B1 | 4/2001 | Olsen |
| 6,224,482 | B1 | 5/2001 | Bennett |
| 6,231,442 | B1 | 5/2001 | Mayeroff |
| 6,231,445 | B1 | 5/2001 | Acres |
| 6,261,177 | B1 | 7/2001 | Bennett |
| 6,280,325 | B1 | 8/2001 | Fisk |
| 6,305,686 | B1 | 10/2001 | Perrie et al. |
| 6,309,300 | B1 | 10/2001 | Glavich |
| 6,328,649 | B1 | 12/2001 | Randall et al. |
| 6,364,314 | B1 | 4/2002 | Canterbury |
| 6,364,768 | B1 | 4/2002 | Acres et al. |
| 6,371,852 | B1 | 4/2002 | Acres |
| 6,375,187 | B1 | 4/2002 | Baerlocher |
| 6,375,567 | B1 | 4/2002 | Acres |
| 6,375,569 | B1 | 4/2002 | Acres |
| 6,599,192 | B1 | 7/2003 | Baerlocher et al. |
| 6,758,750 | B2 | 7/2004 | Baerlocher et al. |
| 6,852,030 | B2 | 2/2005 | Baerlocher et al. |
| 6,966,834 | B1 * | 11/2005 | Johnson ..... 463/25 |
| 2003/0236116 | A1 | 12/2003 | Marks et al. |
| 2004/0053662 | A1 * | 3/2004 | Pacey ..... 463/16 |
| 2005/0130729 | A1 | 6/2005 | Baerlocher et al. |

FOREIGN PATENT DOCUMENTS

| | | | |
|---|---|---|---|
| EP | 898253 | A2 * | 2/1999 |
| EP | 0926645 | A2 | 6/1999 |
| EP | 0944030 | A2 | 9/1999 |
| EP | 0945837 | A2 | 9/1999 |
| EP | 0981119 | A2 | 2/2000 |
| EP | 0984408 | A2 | 3/2000 |
| EP | 0984409 | A2 | 3/2000 |
| GB | 970806 | | 9/1963 |
| GB | 2 322 217 | | 12/1997 |
| GB | 2350715 | A * | 12/2000 |
| GB | 2 368 539 | | 5/2002 |
| GB | 2 387 950 | | 10/2003 |
| WO | WO 96/23286 | | 8/1996 |
| WO | WO 97/32285 | | 9/1997 |
| WO | WO9737737 | | 10/1997 |
| WO | WO 00/12186 | | 3/2000 |
| WO | WO 00/32286 | | 6/2000 |
| WO | WO03045520 | | 6/2003 |

OTHER PUBLICATIONS

Jackpot Party Advertisements and Articles written by WMS Gaming, Inc., published in 1998.
MegaJackpots Advertisement written by IGT, published in 1998.

* cited by examiner

ENTERTAINMENT AND GAMING DEVICES COUPLED TO AN INDICATION OF PAYOUT PERCENTAGE CHARACTERISTICS

PRIORITY CLAIM

This application claims priority to United Kingdom Patent Application No. GB 0310924.6, filed on May 13, 2003, entitled "Entertainment Machines," the entire disclosure of which is incorporated herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

This invention relates to coin-operated player operable entertainment machines. As used herein the term coin is intended also to cover notes, tokens, charge or credit cards or any other means of supplying credit or monetary value.

BACKGROUND OF THE INVENTION

It is known to link separate entertainment machines to provide an additional playing feature derived from an interrelationship between the machines.

GB 2350715A describes an assembly of machines linked to a common display device. When a special game feature becomes available on any of the machines, play of the feature takes place and is displayed on the individual machine where it can be seen by the player of that machine, and at the same time play of the feature is displayed on the common display device where it can also be seen by other players.

GB 2322217A also describes an assembly of machines linked to a common display device. In this case, when a special game feature becomes available on any of the machines, play then transfers to the common display device. Play of the feature takes place and is displayed on the common display device where it can be seen by other players.

These prior arrangements use an enlarged common display device which acts to attract players to the machines. The attraction is to the linked machines in general rather than to the machines individually.

SUMMARY OF THE INVENTION

An object of the present invention is to provide an assembly of machines with a common display device which can attract players to individual machines thereby to encourage players to play different machines of the assembly.

According to the invention therefore there is provided an assembly of coin-operated player-operable entertainment machines and at least one common display device for the machines wherein each machine is operable to play games having outcomes, at least one of which is a winning outcome, in dependence on at least one machine parameter, characterized in that the (or each) common display device is operable to indicate differences in characteristics of at least one said machine parameter.

With this arrangement, the (or each) common display device can act to alert players to the existence of a difference in one or more machine parameters which influence game outcome between different machines. This can encourage players to move from machine to machine in pursuit of machines which are perceived to operate in a manner more favorable to the player and/or to experience enhanced game play variety.

In a preferred embodiment the machine parameter characteristics relate to the likelihood of winning. In particular, in the case where the machines are gaming machines which require a stake value to be credited for the playing of a game and which make available an award value on attainment of a winning outcome, the machine parameter characteristics may be the value of the percentage of overall stake value which the machine is designed to return as award value or payout.

The common display device may provide a qualitative indication, e.g., such as to indicate that one machine has a higher payout percentage. Alternatively, the common display device may provide a quantitative indication, e.g., such as to indicate that three machines are running at say 92%, 88% and 76% pay out percentage respectively.

The indication may identify the machines in relation to the parameter characteristics. Alternatively and preferably the indication may give no information as to the identity of the machines in relation to the characteristics so that players have to guess or try to find out for themselves.

The indication may be of an alphanumeric nature on an appropriate digital display device. Other kinds of indications involving back illumination of informative printed panels or the like can also be used.

The machine parameter characteristics may be fixed or preset in relation to the established assembly of machines. Alternatively and preferably they are adjustable and they may be changed on any predetermined, random or pseudo random basis. In one embodiment, the characteristics are changed at predetermined times of day, e.g., at midnight effected by adjustment control devices of the machines and/or by a separate linked adjustment control device, e.g., incorporated in a remote server or computer unit at a central control location remote from the machines.

There may be a single common display device or a plurality of such devices. In the latter case the devices may be of the same kind and may provide the same indication at the same time.

The (or each) common display device may be operated by a display control device which may be incorporated in one of the machines and/or which may be separate to the machines and which may be incorporated in the aforesaid remote server or computer unit.

The (or each) common display device may comprise a device separate from the machines. In this case it may be mounted on the assembly of machines, where the machines are close together, or on or alongside one of the machines, or at a location wholly separate from the machines. Where a separate adjustment and/or display control device is provided as aforesaid the (or one) common display device may be incorporated in or mounted on or close to such devices.

Alternatively or additionally to provision of one or more common display devices separate from the machines it is possible to incorporate one or more common display devices in one or more of the machines.

Linking between the (or each) common display device and the machines may occur directly and/or via any intermediary device, e.g., the aforesaid remote server or computer unit. The linking may be such that data representing the machine parameter characteristics is received from the machines and used to operate the (or each) common display device. In an alternative arrangement the (or each) common display device does not receive data from the machines but receives data from an intermediary device such as the aforesaid separate server or computer unit which may itself collect data from the machines. It is also possible for the (or each) common display device to receive data from an intermediary device, such as the aforesaid server or computer unit, which data corresponds to data sent by the intermediary device to the machines to set the machine parameter characteristics, instead of, or additionally to, data being collected from the machines.

Linking may be achieved in any suitable manner using cable links and/or wireless links (radio or infra red) between the machines, the (or each) common display device and any separate control device or other intermediary device. The linking may be active on a continuous or periodic basis or only when required.

With regard to the machines these may be of the fruit or poker machine kind having a main display device operable to display a selected combination of symbols. The main display device may comprise actual or simulated rotatable side by side, symbol-bearing reels. Alternatively or additionally, the machines may be other kinds of machines such as video gaming machines or the like.

The machines together with the (or each) common display device and any, separate control device may be located in the same premises, e.g., the same public house or club or the like. Alternatively, the assembly may be distributed over two or more premises and, in particular, the separate server or computer unit, where provided, may be disposed remotely in separate premises from the machines, or may be controlled from further linked control equipment located remotely from premises containing the machines.

DETAILED DESCRIPTION OF THE INVENTION

Figure 1:
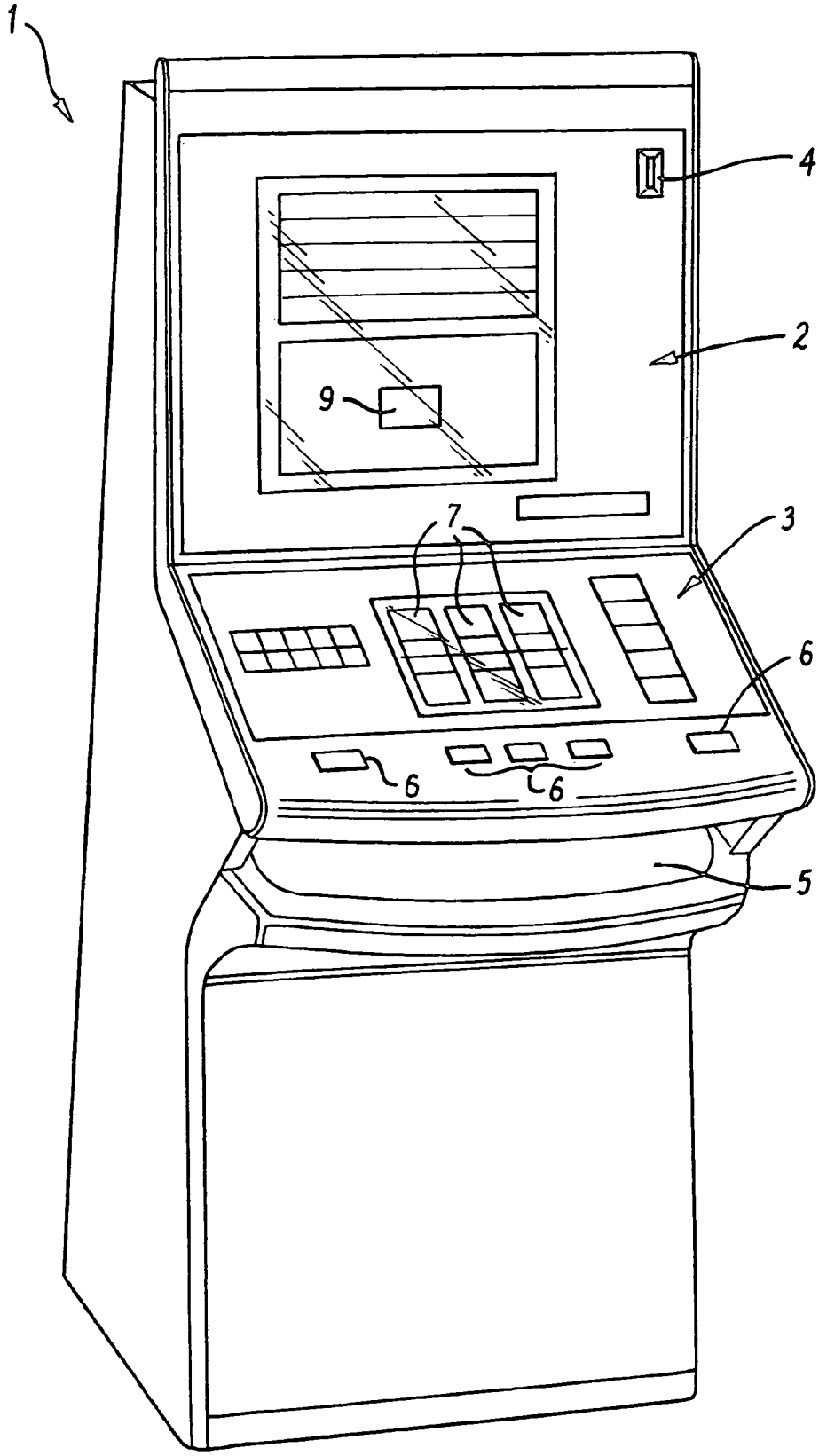
FIG. 1 is a diagrammatic representation of a machine of one form of an assembly of machines in accordance with the present invention.
Figure 2:
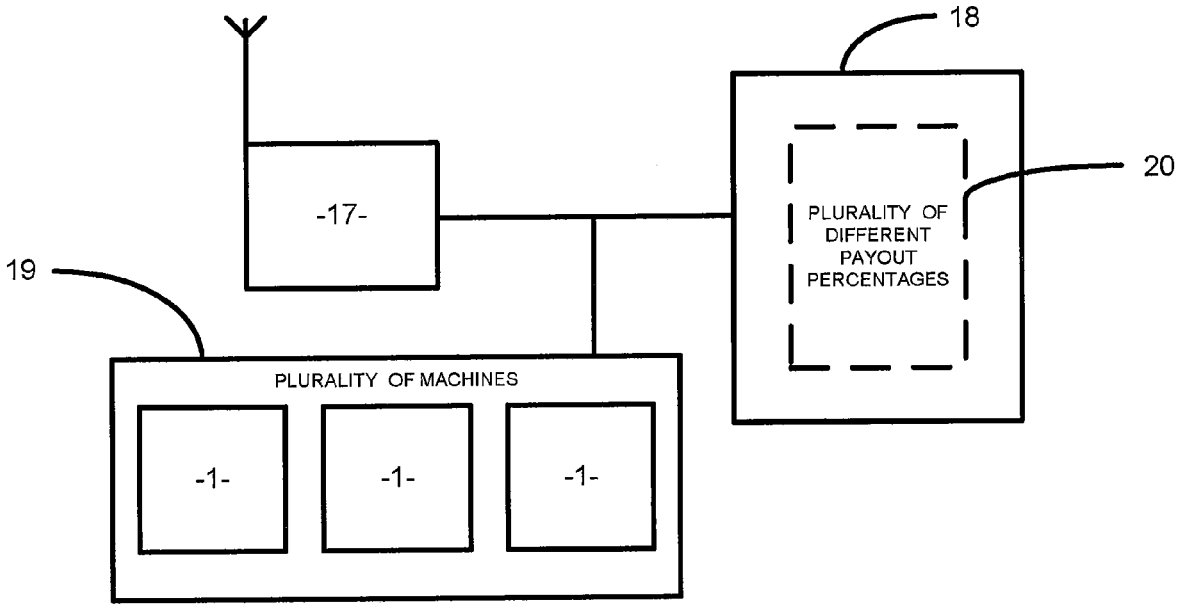
FIG. 2 is a diagrammatic block circuit diagram of part of the assembly.
Figure 2:
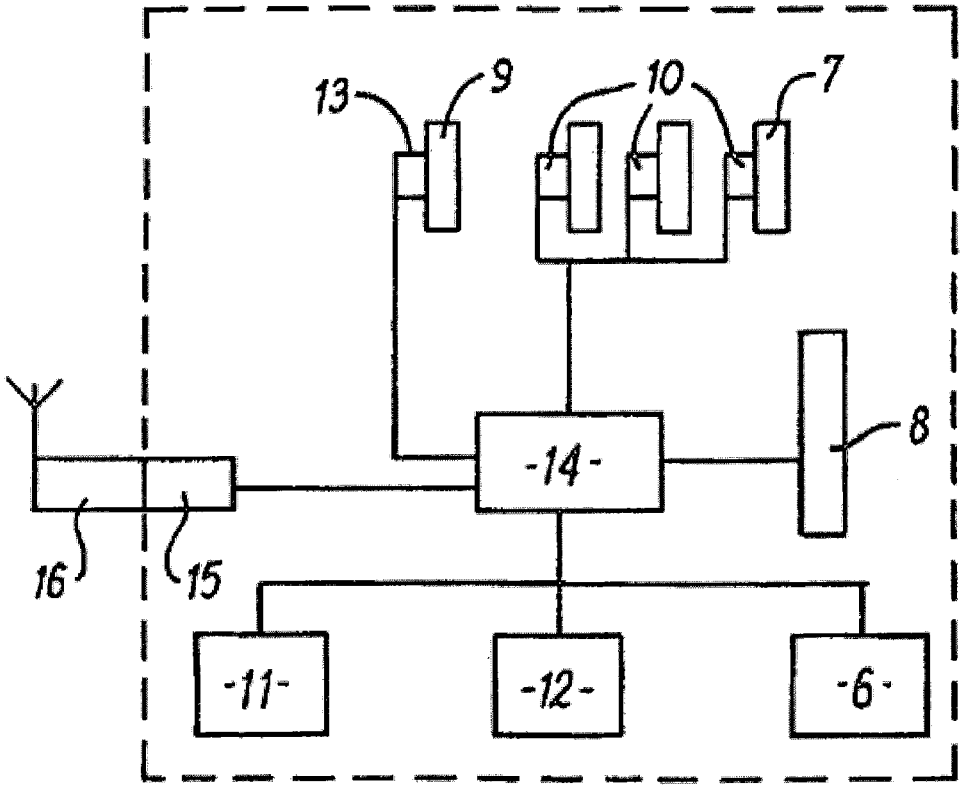

The invention will now be described further by way of example only and with reference to the accompanying drawings in which, referring to the drawings, FIG. 1 shows one machine of a plurality of fruit machines 1 located at different positions within premises such as a public house.

Each machine 1 is of conventional form and has a floor-standing cabinet 20 with upper and lower front panels 2 and 3. There is a coin slot 4, a payout opening 5 and operating buttons 6.

Within the cabinet 20, three symbol bearing reels 7 are rotatable behind a window in the lower panel 3. The upper panel 2 has a feature game 22 with sections which can be backlit with lamps 8, and a number-bearing selector reel 9.

Driver motors 10 of the reels 7, a coin mechanism 11 connected to the slot 4, a payout mechanism 12 connected to the opening 5, the lamps 8, and a driver motor 13 of the feature reel 9 are all connected to a microprocessor control unit 14 within the cabinet 20 of the machine 1.

In use, a game can be played on each machine 1 after coins at least equal to a predetermined game stake value have been credited to the machine 1 by insertion through the slot 4. The game is started by pressing a start button 6, and the reels 7 rotate and come to rest to display a combination of symbols on one or more win lines in the window in the panel 3.

If the combination of symbols is of a predetermined winning nature an award value is credited to the player and is paid out when a payout button 6 is pressed.

In conventional manner 'nudge' and 'hold' buttons 6 can be operated to seek to influence the attained symbol combination, and play can progress or transfer to the feature game 22 on the panel 2 or other features whereby the player can seek to attain further wins resulting in credited award value.

Operation of the machine 1, controlled by the control unit 14 occurs on a random basis with win likelihood, determined by factors such as distribution of the reel symbols, frequency of availability of 'nudge' and 'hold' buttons, etc, pre-set to give a desired overall statistical percentage of staked value paid out as awards. The control unit 14 may operate to monitor actual payout percentage and to take action to influence game outcome to try to ensure that the actual payout percentage does not depart significantly from the pre-set percentage when considered over predetermined number of games.

Each machine 1 has a socket 15 accessible to authorized personnel, e.g., within the machine cabinet behind a locked door, by means of which the payout percentage can be pre-set and changed. Different plugs are conventionally provided for insertion into the socket, each plug corresponding to a different respective payout percentage. The plugs provide data pulses, or switched connections which are interpreted by the control unit 14 and are used to effect the desired payout percentage.

In accordance with the embodiment of the present invention, instead of the conventional percentage plug, each of these sockets 15 of each machine 1 is fitted with a link plug 16 which links the machine to a remote server or computer unit 17 located at an appropriate position in the premises, e.g., in a secure room.

These link plugs 16 contain terminals which connect with the sockets 15, a wireless transmitter/receiver device which may be a radio device or an infrared device, and circuitry interconnecting the terminals and the wireless device.

The remote server 17 contains a compatible wireless transmitter/receiver device or is connected to one or more such devices located in the vicinity of the link plugs. Two-way data communication is thereby established between the percentage sockets of the machines 1 and the server 17.

The server 17 is also connected to one or more alphanumeric display boards 18, described hereinafter, arranged at a prominent position or positions within the premises so as to be readily noticeable to potential players of the machines. The connection between the server 17 and the board(s) 18 may be by cable or wireless link.

The machines 1 are pre-set with payout percentages and this is achieved by feed of data signals from the server 17 via wireless transmission to the link plugs 16. The transmitted data signals are used to effect appropriate switching in the machines 1 thereby to effect control of the payout percentages.

The transmitted data signals are such as to establish different payout percentages for different machines 1. For example, there may be three machines 1 which may be set for say 92%, 88%, 76%. It is not necessary for all machines 1 to have different payout percentages. Some machines 1 may have the same payout percentage.

The required payout percentages may be selected and transmitted to the machines 1 as initiated by an authorized operator in the premises, e.g., by using a keyboard connected to the server 17. Alternatively, initiation of percentages may be effected automatically by software in the server 17. It is also possible for the initiation to be effected by remote link to the server, e.g., from a central control location remote from the premises linked by telephone or cable or otherwise.

The arrangement is preferably such that the payout percentages can be changed. This may be effected on demand as and when required. Alternatively, it may be effected periodically, say, every day at midnight, or more frequently.

The data may be routed to the respective machines 1 in any suitable manner. For example, wireless transmissions may be frequency distinguished so that each machine 1 only picks up the data transmission intended for that machine. Alternatively, the data may be address-coded so that it is picked up by all machines 1 but only used by the intended machine 1.

The current plurality of different payout percentages 20 of the respective plurality 19 of machines 1 are shown on the (or each) common display device or display board 18. That is, the percentages are stored in the server 17 and fed to the display board(s) 18 so as to produce an alphanumeric indication giving the percentages without identifying the respective machines 1 to which these relate. Thus, the indication may constitute the wording "One of the three machines is running at 92%, one at 88% and one at 76%." This indication may be constantly maintained, at least during opening hours of the premises, changing when the percentages are changed.

With this arrangement, players entering the premises on seeing the board(s) 18 are alerted to the different payout percentages and the players are therefore encouraged to move from machine to machine within the premises, instead of playing the same machine, to try to find the highest payout machine. This adds to player interest.

It is of course to be understood that the invention is not intended to be restricted to the details of the above embodiment which are described by way of example only. Thus, for example, the machines 1 need not all be of the same kind, they may be of mixed kinds including fruit machines, poker machines, video gaming machines and the like, and there may be any number of machines 1, depending on the ability of the display board(s) 18 to provide information for all machines.

The invention is hereby claimed as follows:

1. An assembly comprising:

a plurality of coin-operated player-operable entertainment machines, each one of the machines configured to implement one of a plurality of different payout percentages, each different payout percentage determined based on: (i) a plurality of awards associated with a plurality of winning outcomes and (ii) for each of the plurality of winning outcomes, a probability of said winning outcome occurring in a play of a game;

at least one common display device for the plurality of machines; and at least one processor configured to cause the at least one common display device to indicate a plurality of the different payout percentages which are currently being implemented by the plurality of machines, the indication occurring:

(i) without outputting an identification of which of the machines are currently implementing which of the indicated payout percentages, and (ii) independent of any of the outcomes generated by any of the plurality of machines.

2. The assembly of claim 1, wherein; (a) at least one of the different payout percentages is an adjustable payout percentage; and (b) the at least one processor is configured to:

(x) monitor the adjustable actual payout percentage; and (y) control a deviation of the adjustable actual payout percentage relative to a pre-set payout percentage.

3. The assembly of claim 1, wherein at least one of the payout percentages is an adjustable actual pay out percentage.

4. The assembly of claim 1, wherein at least one of the payout percentages is a pre-set payout percentage.

5. The assembly of claim 1, wherein at least one of the payout percentages is adjustable.

6. The assembly of claim 1, wherein the common display device includes a device separate from the machines.

7. The assembly of claim 1, which includes a data link between the common display device and the machines.

8. The assembly of claim 7, wherein the data link includes an intermediary device between the common display device and the machines.

9. The assembly of claim 1, wherein the game of at least one of the machines includes a combination of symbols displayed on a main display device.

10. The assembly of claim 9, wherein the main display device comprises rotatable side-by-side symbol-bearing reels.

11. A gaming device having a game configured to operate upon a wager, the gaming device comprising:

a cabinet;

a display device supported by the cabinet; and a processor configured to operate with a server, the processor configured to:

(a) operate the game using at least a first one plurality of different payout percentages, the plurality of payout percentages being usable by each of the processor and a plurality of gaming device processors of a plurality of other gaming devices, each different payout percentage determined based on: (i) a plurality of awards associated with a plurality of winning outcomes and (ii) for each of the plurality of winning outcomes, a probability of said winning outcome being generated in a play of the game;

(b) receive data from the server, said data causing the processor to use the first one of the payout percentages, the server being in communication with a display apparatus selected from the group consisting of: the display device supported by the cabinet and a common display device; and (c) cause the display apparatus to indicate a plurality of the different payout percentages while the indicated payout percentages are currently being used by each of the processor and the other gaming device processors, the indication occurring:

(i) without outputting an identification of which of the processors are currently using which of the indicated payout percentages, and (ii) independent of any of the outcomes generated by the processors of any of the plurality of gaming devices; and (d) provide at least one of the outcomes depending, at least in part, on the first one of the payout percentages.

12. The gaming device of claim 11, wherein: (a) the first one of the payout percentages is an adjustable actual payout percentage; and (b) the processor is configured to:

(x) monitor the adjustable actual payout percentage; and (y) control a deviation of the adjustable actual payout percentage relative to a pre-set payout percentage.

13. The gaming device of claim 11, wherein the display apparatus includes a display panel positioned apart from the gaming devices.

14. A gaming device having a game configured to operate upon a wager, the gaming device comprising:

a cabinet;

a display device supported by the cabinet; and a processor configured to:

(a) operate the game using a first one of a plurality of different payout percentages, the plurality of payout percentages being useable by each of: (i) the processor; and (ii) a plurality of gaming device processors of a plurality of other gaming devices, each different payout percentage determined based on: (i) a plurality of awards associated with a plurality of winning outcomes and (ii) for each of the plurality of winning outcomes, a probability of said winning outcome being generated in a play of the game;

(b) enable data to pass from the processor to a controller of a different display device, said data associated with the first payout percentage; and (c) cause said different display device to indicate a plurality of the different payout percentages while the indicated payout percentages are currently being used by each of the processor and the other gaming device processors, the indication occurring:

(i) without outputting an identification of which of the processors are currently using which of the indicated payout percentages, and (ii) independent of any outcomes generated by the processors of any of the plurality of gaming devices; and (d) provide at least one of the outcomes depending, at least in part, on the first one of the payout percentages.

15. The gaming device of claim 14, wherein: (a) the first one of the payout percentages is an adjustable actual percentage; and (b) the processor is configured to:

(x) monitor the adjustable actual payout percentage; and (y) control a deviation of the adjustable actual payout percentage relative to a pre-set payout percentage.

16. The gaming device of claim 14, wherein the different display device includes a display panel positioned apart from each of the gaming devices.

17. A gaming device having a game configured to operate upon a wager, the gaming device comprising:

a cabinet;

a display device supported by the cabinet; and a gaming device processor configured to operate the game based, at least in part, on a first one of a plurality of different payout percentages, the plurality of different payout percentages being usable by each of the processor and a plurality of gaming device processors of a plurality of other gaming devices, each different payout percentage determined based on: (i) a plurality of awards associated with a plurality of winning outcomes and (ii) for each of the plurality of winning outcomes, a probability of said winning outcome being generated in a play of the game wherein the gaming device processor is configured to operate with an additional processor of an additional display device, the additional processor being configured to:

(a) process data corresponding to the first one of the payout percentages;

(b) process data corresponding to a second one of the plurality of different payout percentages of at least one of the other gaming devices; and (c) cause the additional display device to indicate a plurality of the different payout percentages while the indicated payout percentages are currently being used by each of the processor and the other gaming device processors, the indication occurring:

(i) without outputting an identification of which of the processors are currently implementing which of the different indicated payout percentages, and (ii) independent of any of the outcomes generated by the processors of any of the plurality of gaming devices.

18. The gaming device of claim 17, wherein: (a) the first one of the payout percentages is an adjustable actual payout percentage; and (b) the additional processor is configured to:

(x) monitor actual payout percentage; and (y) control a deviation of the adjustable actual payout percentage relative to a pre-set payout percentage.

19. The gaming device of claim 17, wherein the second one of the payout percentages of the at least one of the other gaming devices is an adjustable actual payout percentage.

20. The gaming device of claim 17, wherein the first one of the payout percentages is a pre-set payout percentage.

21. The assembly of claim 17, wherein the display device supported by the cabinet includes an illuminable printed panel.

22. The gaming device of claim 17, wherein the additional display device indication includes a qualitative indication of the plurality of different payout percentages.

23. The gaming device of claim 17, wherein the additional display device indication includes a quantitative indication of the plurality of different payout percentages.

24. The assembly of claim 1, wherein the common display device includes an illuminable printed panel.

25. The gaming device of claim 1, wherein the common display device indication includes a qualitative indication of the plurality of different payout percentages.

26. The gaming device of claim 1, wherein the common display device indication includes a quantitative indication of the plurality of different payout percentages.

27. The gaming device of claim 11, wherein the first one of the payout percentages is an adjustable actual payout percentage.

28. The gaming device of claim 11, wherein the first one of the payout percentages is a pre-set payout percentage.

29. The gaming device of claim 11, wherein the display device supported by the cabinet includes an illuminable printed panel.

30. The gaming device of claim 11, wherein the display device apparatus indication includes a qualitative indication of the plurality of different payout percentages.

31. The gaming device of claim 11, wherein the display device apparatus indication includes a quantitative indication of the plurality of different payout percentages.

32. The gaming device of claim 14, wherein the first one of the payout percentages is an adjustable actual payout percentage.

33. The gaming device of claim 14, wherein the first one of the payout percentages is a pre-set payout percentage.

34. The gaming device of claim 14, wherein the display device supported by the cabinet includes an illuminable printed panel.

35. The gaming device of claim 14, wherein the different display device indication includes a qualitative indication of the plurality of different payout percentages.

36. The gaming device of claim 14, wherein the different display device indication includes a quantitative indication of the plurality of different payout percentages.

* * * * *